US009624709B2

(12) United States Patent
Friesenecker et al.

(10) Patent No.: US 9,624,709 B2
(45) Date of Patent: Apr. 18, 2017

(54) FLAP DRIVE SYSTEM

(75) Inventors: Gerald Friesenecker, Lauterach (AT); Wolfgang Bohle, Götzis (AT)

(73) Assignee: Julius Blum GmbH, Hochst (AT)

( * ) Notice: Subject to any disclaimer, the term of this patent is extended or adjusted under 35 U.S.C. 154(b) by 598 days.

(21) Appl. No.: 13/274,615

(22) Filed: Oct. 17, 2011

(65) Prior Publication Data

US 2012/0032570 A1 Feb. 9, 2012

Related U.S. Application Data

(63) Continuation of application No. PCT/AT2010/000162, filed on May 12, 2010.

(30) Foreign Application Priority Data

May 13, 2009 (AT) ..... A 733/2009

(51) Int. Cl.
*A47B 95/00* (2006.01)
*E05F 15/63* (2015.01)
*E05F 1/10* (2006.01)

(52) U.S. Cl.
CPC ..... *E05F 15/63* (2015.01); *E05F 1/1058* (2013.01); *E05Y 2201/71* (2013.01);
(Continued)

(58) Field of Classification Search
CPC ..... E05D 15/46; E05F 1/1058; E05F 15/127; E05F 15/63
(Continued)

(56) References Cited

U.S. PATENT DOCUMENTS 2,912,237 A 11/1959 Snyder
3,784,090 A * 1/1974 Markham ..... 232/44
(Continued)

FOREIGN PATENT DOCUMENTS

DE 102005055788 * 5/2007
DE 20 2006 010 188 6/2007
(Continued)

OTHER PUBLICATIONS

International Search Report issued Aug. 27, 2010 in International (PCT) Application No. PCT/AT2010/000162.
(Continued)

*Primary Examiner* — Daniel J Troy
*Assistant Examiner* — Kimberley S Wright
(74) *Attorney, Agent, or Firm* — Wenderoth, Lind & Ponack, L.L.P.

(57) ABSTRACT

The invention relates to a flap drive system for a flap which is movably mounted on a furniture carcass. The flap drive system is arranged on a sidewall of the furniture carcass. The flap drive system includes a mechanical actuating unit having an actuating arm that can be connected to the flap and an accumulator acting upon the actuating arm, and an electric drive, fastened on the mechanical actuating unit for driving the flap. The electric drive has at least one electric motor, and a gear stage which allows the transmission of force from the electric drive onto the mechanical actuating unit. The gear stage is designed as a separate component, and has a housing that is independent from the mechanical actuating unit and the electric drive or an independent mounting plate.

25 Claims, 5 Drawing Sheets

(52) U.S. Cl.
CPC ... *E05Y 2600/522* (2013.01); *E05Y 2800/205* (2013.01); *E05Y 2800/22* (2013.01); *E05Y 2800/264* (2013.01); *E05Y 2800/72* (2013.01); *E05Y 2900/20* (2013.01)

(58) Field of Classification Search
USPC ..... 312/325, 327, 328, 319.5–319.8, 322, 312/323, 319.2, 326; 16/286, 354
See application file for complete search history.

(56) References Cited

U.S. PATENT DOCUMENTS

| | | | | |
|---|---|---|---|---|
| 5,971,514 | A * | 10/1999 | Hayakawa | 312/319.2 |
| 6,195,940 | B1 * | 3/2001 | Moy | 49/324 |
| 6,241,300 | B1 * | 6/2001 | Suzuki | 296/37.8 |
| 6,283,535 | B1 * | 9/2001 | Yuge | 296/146.8 |
| 6,682,157 | B2 * | 1/2004 | Ito | 312/319.6 |
| 7,178,202 | B2 * | 2/2007 | Hirtsiefer | 16/366 |
| 7,240,974 | B2 * | 7/2007 | Hirtsiefer | 312/109 |
| 7,331,643 | B2 * | 2/2008 | Huber et al. | 312/319.5 |
| 7,448,703 | B2 * | 11/2008 | Kung | 312/327 |
| 7,478,891 | B2 * | 1/2009 | Hollenstein | 312/319.2 |
| 7,497,532 | B2 * | 3/2009 | Salice | 312/328 |
| 7,500,287 | B2 * | 3/2009 | Brustle | 16/286 |
| 7,573,215 | B2 * | 8/2009 | Hillen | 318/280 |
| 7,810,213 | B2 * | 10/2010 | Brustle | 16/286 |
| 7,980,151 | B2 | 7/2011 | Hormann | |
| 8,011,741 | B2 * | 9/2011 | Mattle | 312/319.5 |
| 8,029,078 | B2 * | 10/2011 | Gasser | 312/319.5 |
| 8,056,991 | B2 * | 11/2011 | Hollenstein | 312/312 |
| 8,066,341 | B2 * | 11/2011 | Brustle | 312/319.5 |
| 8,109,583 | B2 * | 2/2012 | Bruestle | 312/319.2 |
| 2002/0117863 | A1 * | 8/2002 | Shinkawa | 292/216 |
| 2006/0174444 | A1 * | 8/2006 | Giovannetti | 16/354 |
| 2006/0284530 | A1 * | 12/2006 | Hollenstein | 312/327 |
| 2007/0114960 | A1 * | 5/2007 | Hillen | 318/280 |
| 2007/0180654 | A1 * | 8/2007 | Gasser | 16/242 |
| 2007/0193384 | A1 * | 8/2007 | Hormann | 74/421 A |
| 2008/0054771 | A1 * | 3/2008 | Brunnmayr | 312/323 |
| 2008/0121490 | A1 * | 5/2008 | Dubach et al. | 192/17 D |
| 2008/0122332 | A1 * | 5/2008 | Brustle | 312/319.2 |
| 2009/0261696 | A1 * | 10/2009 | Hollenstein et al. | 312/327 |
| 2009/0265992 | A1 * | 10/2009 | Hass et al. | 49/340 |
| 2010/0026153 | A1 | 2/2010 | Mattle | |
| 2010/0043595 | A1 * | 2/2010 | Mattle | 74/625 |
| 2010/0327717 | A1 * | 12/2010 | Huber et al. | 312/319.5 |
| 2011/0062842 | A1 * | 3/2011 | Huber et al. | 312/319.5 |
| 2012/0049709 | A1 * | 3/2012 | Scheffknecht et al. | 312/319.6 |
| 2012/0056521 | A1 * | 3/2012 | Friesenecker | 312/319.6 |

FOREIGN PATENT DOCUMENTS

| | | |
|---|---|---|
| DE | 20 2007 014 560 | 3/2009 |
| EP | 2 050 911 | 4/2009 |
| JP | 2009-114844 | 5/2009 |
| JP | 2010-527415 | 8/2010 |
| JP | 2011-511890 | 4/2011 |
| WO | 2008/134786 | 11/2008 |

OTHER PUBLICATIONS

Austrian Patent Office Search Report issued Mar. 25, 2010 in Austrian Patent Application No. A 733/2009.

* cited by examiner

FLAP DRIVE SYSTEM

This application is a Continuation of International application No. PCT/AT2010/000162, filed May 12, 2010, the entire disclosure of which is incorporated herein by reference.

BACKGROUND OF THE INVENTION

The invention concerns a flap drive system for a flap mounted movably to a furniture carcass, the flap drive system being arranged at a side wall of the furniture carcass. The flap drive system includes a mechanical actuating unit having an actuating arm which can be connected to the flap and a force storage means acting on the actuating arm, and an electric drive fixed to the mechanical actuating unit for driving the flap. The electric drive has at least one electric motor and a transmission stage which permits a transmission of force from the electric drive to the mechanical actuating unit.

Flap drive systems for a flap mounted movably to a furniture carcass are already known and are illustrated, for example, in WO 2008/134786. The disadvantage there is that this flap drive system is only designed for mechanical actuating units which are sized for this system and therefore cannot be mounted to different mechanical actuating units. It is thus necessary to produce, for each mechanical actuating unit, an electric drive which has specific dimensions for same, and that is linked to high cost levels.

SUMMARY OF THE INVENTION

The object of the invention is to overcome the above-described disadvantage and to provide a flap drive system which is improved over the state of the art.

In the flap drive according to the invention, the object is achieved in that the transmission stage is in the form of a self-contained component having a housing which is independent of the mechanical actuating unit and the electric drive or an independent mounting plate.

In other words, there is provided a transmission stage which is not part of the electric drive or the mechanical actuating unit. That transmission stage can be of such dimensions that it can operate independently of the electric drive and the mechanical actuating unit. That has the advantage that different mechanical actuating units can be driven with one electric drive as it is only the transmission stage that has to be appropriately dimensioned, and not the electric drive itself or the mechanical actuating unit. That, therefore, provides an inexpensive variant for different mechanical actuating systems and electric drives for flap drive systems. Equally, it is possible for mechanical actuating units to be subsequently provided with a transmission stage according to the invention and an electric drive, as all necessary adaptations in respect of the electric drive to the mechanical actuating unit can be implemented by the transmission stage. If the transmission stage is equipped with a housing, it can be particularly easily fitted to the mechanical actuating unit, or the electric drive can be easily mounted to the transmission stage.

Further advantageous embodiments of the invention are defined in the appendant claims:

In a further embodiment, the electric drive can have a further (second) transmission stage. It has also proven advantageous if the transmission of the transmission stage can locally displace the force transmission from the electric drive to the mechanical actuating unit. The transmission stage is thus capable of introducing the force of the electric drive into the mechanical actuating unit at various predeterminable locations.

In that respect, it has proven to be advantageous if the transmission of the transmission stage causes an increase or a reduction in the length of the travel path described by a projection of the transmission stage, which transmits the force from the transmission stage to the mechanical actuating unit. The transmission stage is thus capable of driving mechanical actuating units, whose actuating arms have to describe a longer or shorter travel path during the flap opening and closing movement.

In a further embodiment, it has proven advantageous if the transmission of the transmission stage can alter, that is to say increase or reduce, the torque from the electric drive to the mechanical actuating unit as in that way it is also possible to advantageously move flaps of differing weight.

In that respect, it has been found to be particularly advantageous if the transmission stage has a mounting for the electric drive as in that way the electric drive can be mounted to the transmission stage quickly and in accurate positional relationship.

Equally, it has been found to be advantageous if the transmission stage can be fixed to the mechanical actuating unit and/or the furniture carcass as mounting of the transmission stage can thus be effected in different ways. It is equally advantageous if the drive unit can be mounted to the transmission stage after the transmission stage is mounted to the mechanical actuating unit as in that way the transmission stage does not have to be separated from the mechanical actuating unit.

It has proven to be particularly advantageous in that respect if the transmission stage can be fixed to the furniture carcass or the mechanical actuating unit even when the mechanical actuating unit is already mounted to the furniture carcass as it is then not necessary to dismantle the mechanical actuating unit from the furniture carcass to fit the transmission stage.

It has proven advantageous in that respect if the mechanical actuating unit, the transmission stage and the electric drive can respectively be connected together in such a way that their side surfaces lie against each other. It is possible in that way to achieve an extremely compact structure which takes up the minimum amount of space in the furniture carcass.

It has proven particularly advantageous in that respect if the mechanical actuating unit, the transmission stage and the electric drive are adapted to be releasably assembled together. That makes a positive contribution to the maintenance-friendliness of the flap drive system as in that way the entire flap drive system does not have to be replaced if one of the units should be defective.

The article of furniture according to the invention is characterized by at least one flap drive system of the kind described.

BRIEF DESCRIPTION OF THE DRAWINGS

Further details and advantages of the present invention are described with reference to the specific description hereinafter. In the drawings.

DETAILED DESCRIPTION OF THE INVENTION

Figure 1:
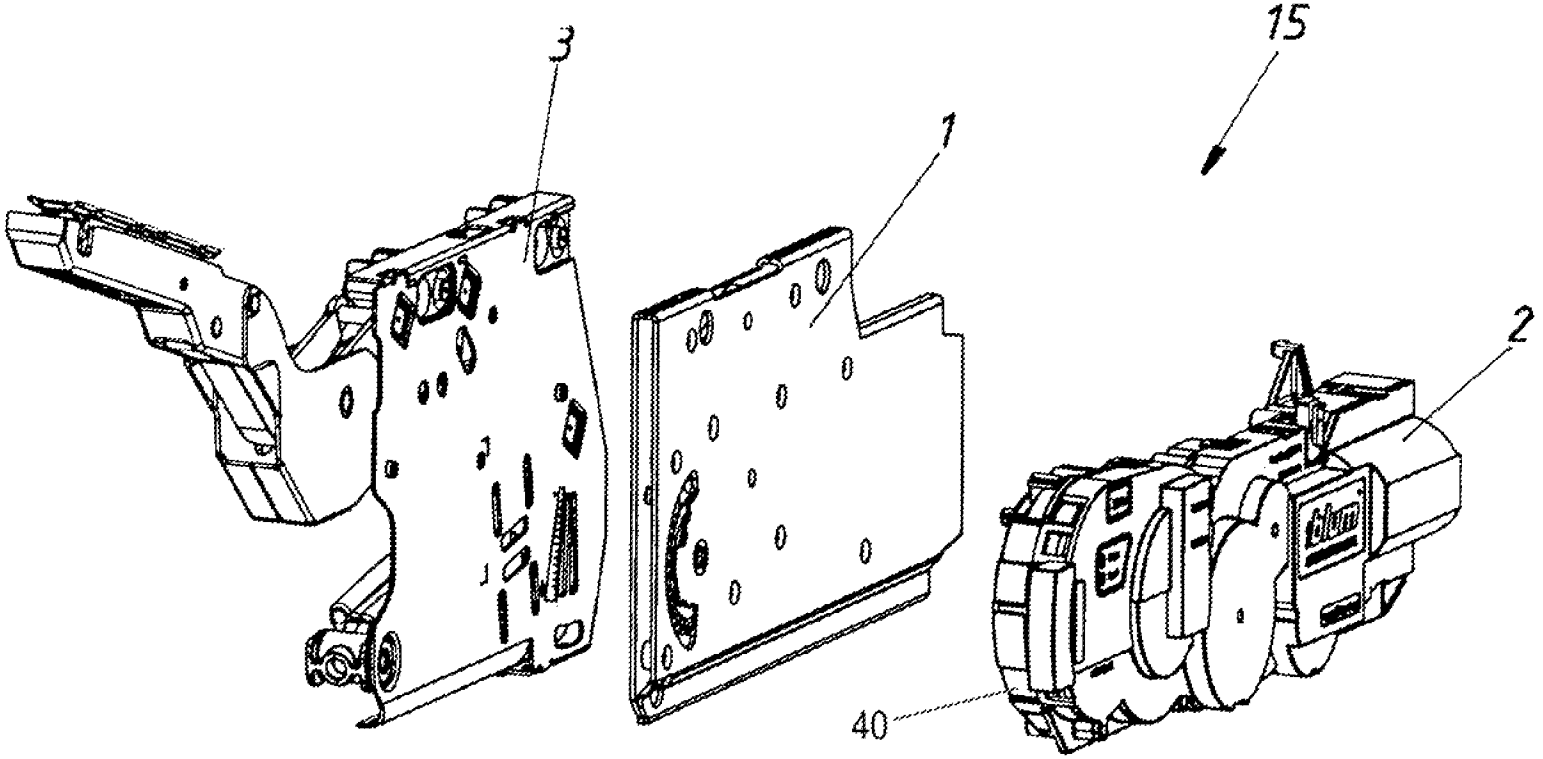
FIG. 1 shows a view of an exploded flap drive system according to the invention.

FIG. 1 shows a flap drive system 15 comprising a mechanical actuating unit 3, a transmission stage 1 and an electric drive 2. It will be seen from FIG. 1 that the transmission stage 1 represents a self-contained component separate from the mechanical actuating unit 3 and the electric drive 2.

Figure 2:
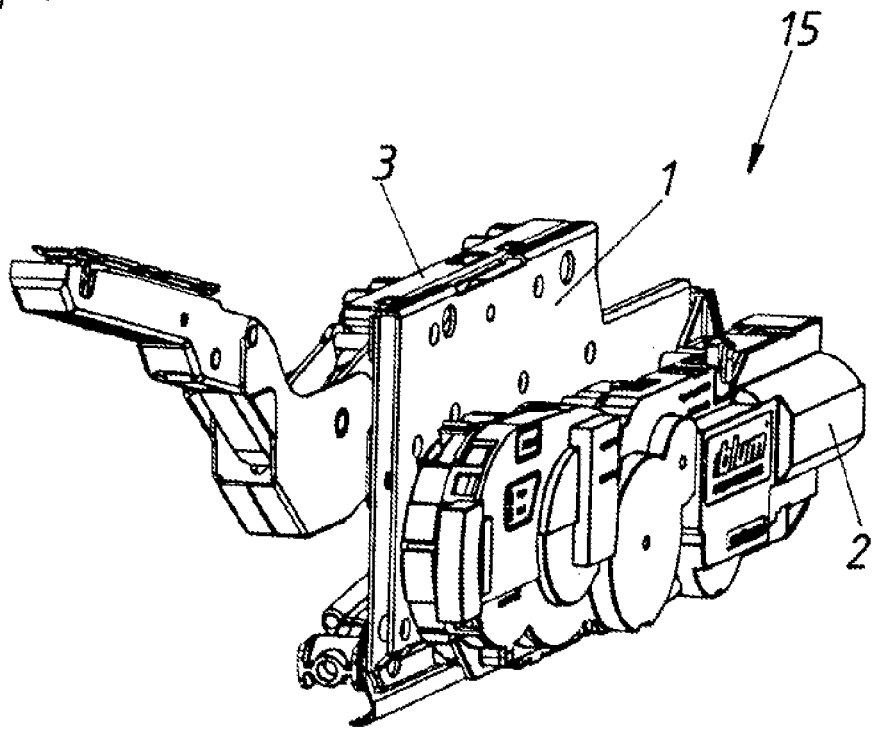
FIG. 2 shows a view of an assembled flap drive system according to the invention.

FIG. 2 shows a flap drive system 15 on which the three assemblies—namely the transmission stage 1, the electric drive 2 and the mechanical actuating unit 3—are connected together.

Figure 3:
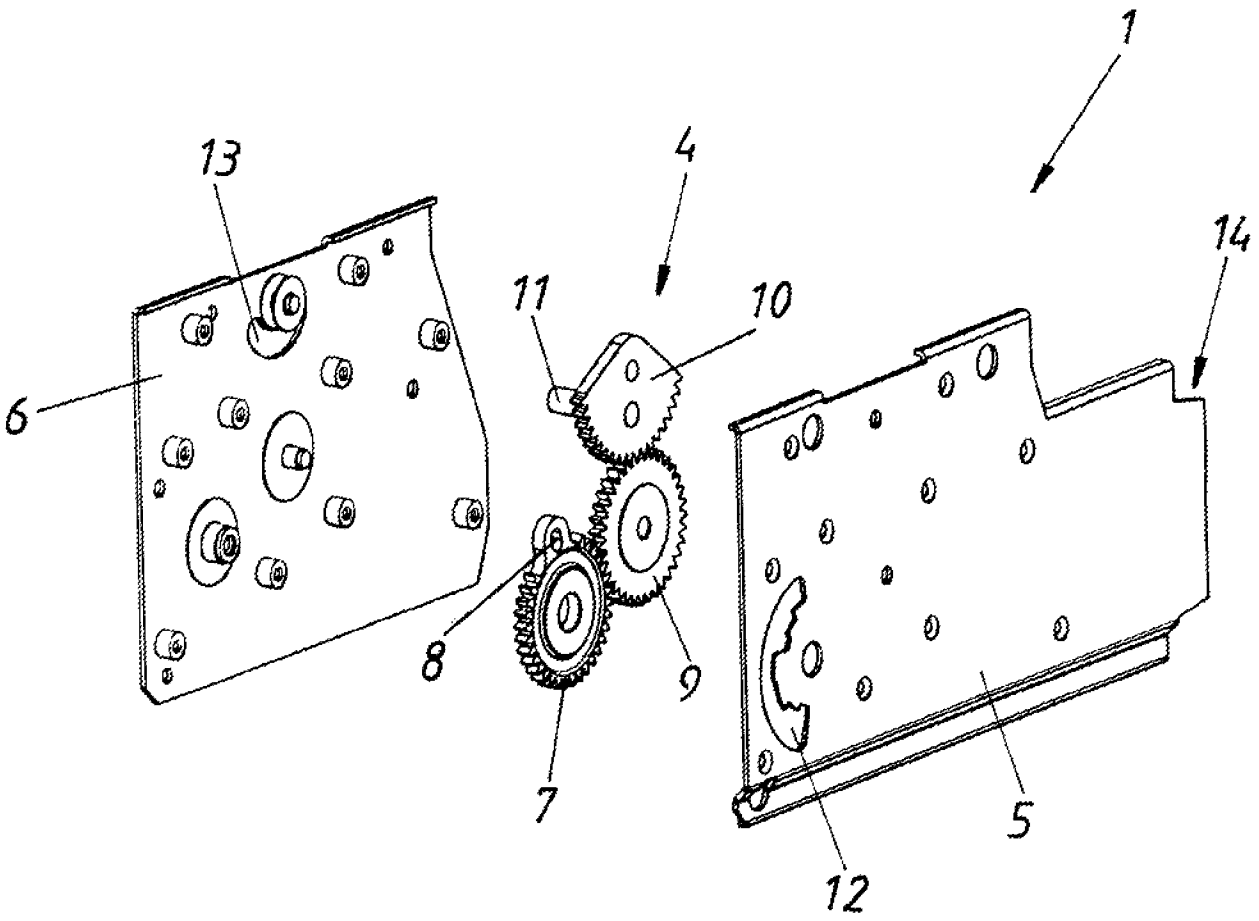
FIG. 3 shows a view of the interior of a transmission stage.

FIG. 3 shows an exploded view of the transmission stage 1 comprising a right-hand (second) housing portion 5 and a left-hand (first) housing portion 6 between which there is a transmission 4. A pin (not shown here) of the electric drive is introduced into the pin receiving section 8 through an opening 12 in the right-hand housing portion 5. The projection 11 in turn acts through the opening 13 of the left-hand housing portion 6 on a corresponding receiving means (not shown) in the mechanical actuating unit 3. The electric drive 2 is mounted to the drive mounting 14 of the transmission stage 1, in which case the above-mentioned pin of the electric drive 2 projects into the pin receiving section 8. The pin of the electric drive 2 drives the mechanical actuating unit by way of the intermediate gear 9 and the projection 11. This embodiment involves both a lateral displacement of the transmission of force to the mechanical actuating unit 3 and also, by suitable dimensioning of the gears (7, 9, 10), an increase or reduction in the torque. The external shape of the drive mounting 14 of the transmission stage 1 ensures that the same electric drive 2 can be used for different mechanical actuating units 3 and also for different transmission stages 1. Suitable dimensioning of the gear 10 and a suitable choice for the position of the projection 11 on the gear 10 make it possible to increase or reduce the length of the travel path covered by the projection 11. It will be appreciated that the transmission stage 1 can also be designed in such a way that there is neither a change in position nor a change in torque due to the transmission stage 1.

Figure 4:
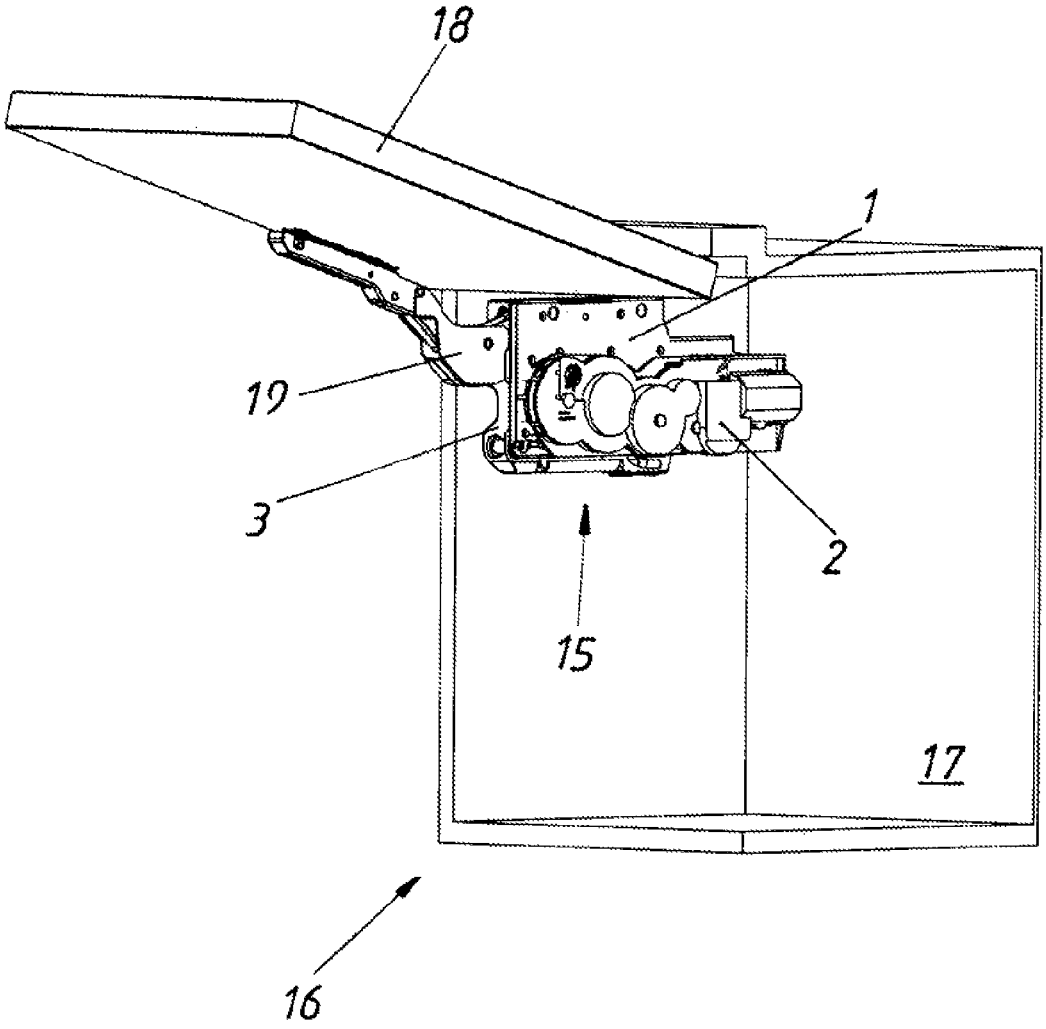
FIG. 4 shows a view of an article of furniture with a flap drive system for moving a furniture flap.

FIG. 4 shows a perspective view of an article of furniture 16 having a furniture carcass 17 and a flap 18 movable relative thereto. In the illustrated embodiment, the flap 18 is in the form of an upwardly pivotable flap. All other known types of flap can advantageously also be used. At least one flap drive system 15 is to be fixed on a side wall of the furniture carcass 17 for moving the flap 18. The electric drive 2 of the flap drive system 15 acts by way of the transmission stage 1 on the mechanical actuating unit 3. The mechanical actuating unit 3 has an actuating arm 19 which in this embodiment is in the form of a lever mechanism. The flap 18 is movable in further succession by way of the actuating arm 19. It will be appreciated that the actuating arm 19 of the mechanical actuating unit 3 can equally be in the form of a one-piece lever or the mechanical actuating unit 3 could be designed, for example, with a drive stub to which a further lever arm can be connected to move the flap 18.

FIGS. 5*a* through 5*e* show the diagrammatic installation and assembly procedure for a furniture drive system 15 on a side wall of the furniture carcass 17.

As can already be seen from FIGS. 1 and 2 the mechanical actuating unit 3, the transmission stage 1 and the electric drive 2 are formed with flat side walls by way of which they can be connected together.

Figure 5A:
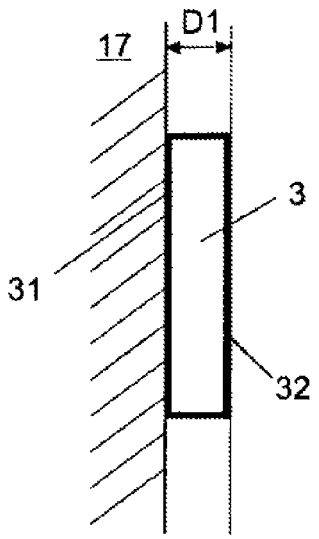
FIGS. 5*a* through 5*e* show a diagrammatic view illustrating the procedure of installing and assembling the flap drive system.

FIG. 5*a* shows a possible installation variant in which, as the first step, the mechanical actuating unit 3 is fixed with its left-hand (first) side surface 31 to a side wall of the furniture carcass 17. At the opposite (second) side surface 32, the mechanical actuating unit 3 has a plate-like configuration (see FIG. 1). The mechanical actuating unit 3 has a very narrow width D1, in a preferred embodiment being of a width D1 of less than between 2 and 3 cm.

Figure 5B:
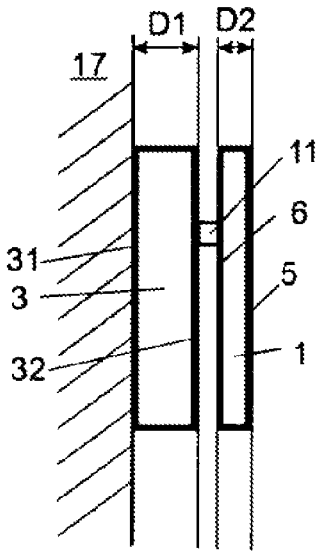
Figure 5C:
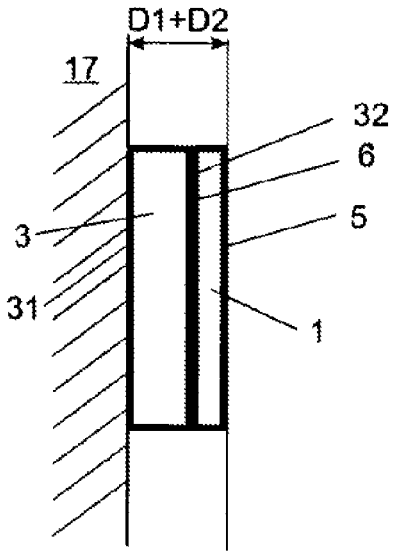

As shown in FIG. 5*b*, the left-hand (first) housing portion 6 of the transmission stage 1—which also has a plate-shaped configuration—is fixed to the second side surface 32 of the mechanical actuating unit 3, the transmission of force being effected by way of the projection 11 (see also FIG. 3). In this case, the projection 11 extends into the mechanical actuating unit 3 to such an extent that the second side surface 32 of the mechanical actuating unit 3 and the first housing portion 6 of the transmission stage 1 bear flat against each other (FIG. 5*c*). As just mentioned in relation to the mechanical actuating unit 3, the transmission stage 1 also has a flat configuration and in the preferred embodiment has a width D2 of less than 2 cm.

Figure 5D:
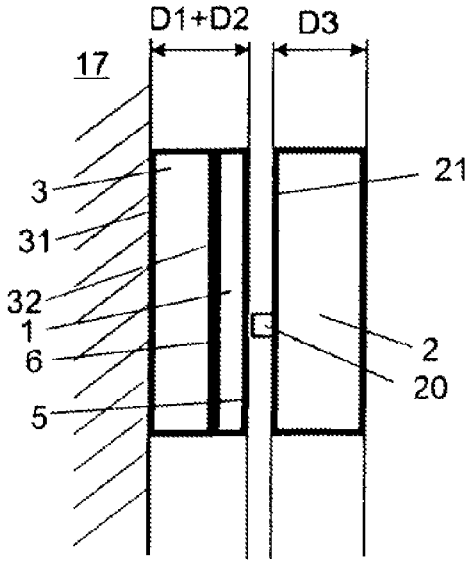
Figure 5E:
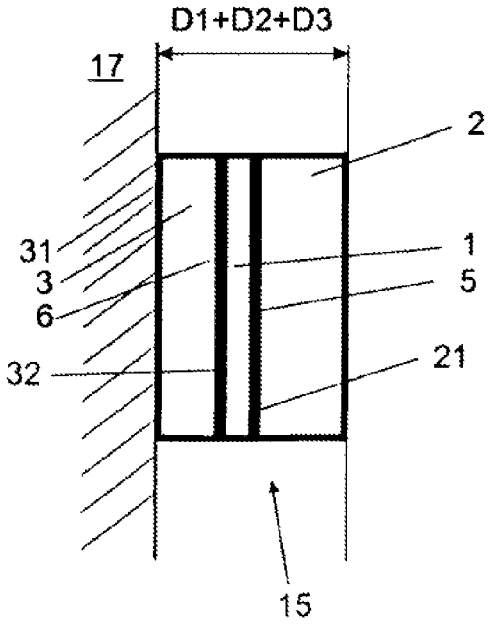

The right-hand (second) housing portion 5 of the transmission stage 1 is also once again in the form of a flat plate on which is arranged the left-hand (first) side surface 21 of the electric drive 2—also in the form of a flat plate 21 (FIG. 5*d*). The transmission of force to the transmission stage 1 takes place by way of the pin 20 of the electric drive 2, by the pin 20 of the electric drive 2 projecting into the pin receiving section 8 (not shown, see FIG. 3). Here too, once again, the pin 20 projects into the transmission stage 1 to such an extent that the plate 21 of the electric drive 2 and the plate 5 of the transmission stage 1 bear flat against each other (FIG. 5*e*).

The electric drive 2 in this case also has a very flat construction, of a preferred width D3 of less than between 4 and 5 cm.

That therefore involves an overall width for the flap drive system 15 in the installed condition, which is approximately the same as the width D1 of the mechanical actuating unit 3 plus the width D2 of the transmission stage 1 plus the width D3 of the electric drive 2. That can be achieved in that way as the transmission mechanisms (the pin 20 and the projection 11) project into the corresponding units (transmission stage 1 and mechanical actuating unit 3).

The fact that the transmission stage 1 can be arranged at the mechanical actuating unit 3 and the electric drive 2 at the transmission stage 1, by way of the flat side surfaces 32, 6, 5, 21 thereof, achieves an overall structure which is extremely compact. Because the electric drive 2 can be connected into the transmission stage 1 and the transmission stage 1 into the mechanical actuating unit 3 by plug connections, it is further possible to provide that they can be easily released from each other again.

The overall structure of all three units 1, 2 and 3 can thus be arranged in extremely compact fashion at a side wall of a furniture carcass 17 and in that way requires little space in the furniture carcass 17.

Even if the invention has been specifically described by means of the illustrated embodiment it will be appreciated that the subject-matter of the application is not limited to that embodiment. Rather features and modifications which serve to carry the idea of the invention into effect are certainly conceivable and wanted. For example, the electric drive 2 can have a further (second) transmission stage 40.

LIST OF REFERENCES

1 transmission stage
2 electric drive
3 mechanical actuating unit
4 transmission
5 right-hand housing portion
6 left-hand housing portion
7 gear of the pin receiving means
8 pin receiving means
9 intermediate gear
10 gear of the projection
11 projection
12 opening for pin of the electric drive
13 opening for projection
14 drive mounting
15 flap drive system
16 article of furniture
17 furniture carcass
18 flap
19 actuating arm
20 pin of the electric drive
21 left-hand side surface of the electric drive
31 left-hand side surface of the mechanical actuating unit
32 right-hand side surface of the mechanical actuating unit
D1 width of the mechanical actuating unit 3
D2 width of the transmission stage 1
D3 width of the electric drive 2

The invention claimed is:

1. A flap drive device comprising:

a mechanical actuating unit including an actuating arm to be connected to a movable flap of an article of furniture, and a force storage member acting on said actuating arm, said mechanical actuating unit having a planar mounting surface;

an electric drive linked to said mechanical actuating unit for driving said actuating arm to move the flap, said electric drive having an electric motor and a planar mounting surface; and a plate-shaped transmission stage for transmitting force from said electric drive to said mechanical actuating unit, said transmission stage comprising a self-contained housing independent of said mechanical actuating unit and said electric drive, said transmission stage having a first planar mounting surface mounted to said planar mounting surface of said mechanical actuating unit so that said first planar mounting surface and said planar mounting surface of said mechanical actuating unit bear flat against each other, and having a second planar mounting surface mounted to said planar mounting surface of said electric drive so that said second planar mounting surface and said planar mounting surface of said electric drive bear flat against each other, said first planar mounting surface and said second planar mounting surface being substantially parallel.

2. The device according to claim 1, wherein said transmission stage comprises a first transmission stage, said electric drive including a second transmission stage.

3. The device according to claim 1, wherein said transmission stage includes a transmission configured to locally displace transmission of force from said electric drive to said mechanical actuating unit.

4. The device according to claim 1, wherein said transmission stage includes a transmission configured to cause an increase or a reduction in a length of a travel path defined by a projection of said transmission stage.

5. The device according to claim 1, wherein said transmission stage includes a transmission configured to cause an increase or reduction in torque from said electric motor to said mechanical actuating unit.

6. The device according to claim 1, wherein said transmission stage has at least one drive mounting, said electric drive being mounted to said at least one drive mounting.

7. The device according to claim 1, wherein said transmission stage is fixed to said mechanical actuating unit.

8. The device according to claim 1, wherein said transmission stage is fixed to said electric drive.

9. The device according to claim 1, wherein said transmission stage is configured to be fixed to said mechanical actuating unit even if said mechanical actuating unit is already mounted to a furniture carcass of the article of furniture.

10. The device according to claim 1, wherein said mechanical actuating unit, said transmission stage, and said electric drive are configured to be connected together so that flat side surfaces of said mechanical actuating unit, said transmission stage, and said electric drive lie against each other.

11. The device according to claim 1, wherein said mechanical actuating unit, said transmission stage, and said electric drive are configured to be releasably assembled together.

12. An article of furniture comprising:

a furniture carcass;

a flap movably mounted to said furniture carcass; and a flap drive device including:

a mechanical actuating unit including an actuating arm connected to said movable flap, and a force storage member acting on said actuating arm, said mechanical actuating unit having a planar mounting surface;

an electric drive linked to said mechanical actuating unit for driving said actuating arm to move said flap, said electric drive having an electric motor and a planar mounting surface; and a plate-shaped transmission stage for transmitting force from said electric drive to said mechanical actuating unit, said transmission stage comprising a self-contained housing independent of said mechanical actuating unit and said electric drive, said transmission stage having a first planar mounting surface mounted to said planar mounting surface of said mechanical actuating unit so that said first planar mounting surface and said planar mounting surface of said mechanical actuating unit bear flat against each other, and having a second planar mounting surface mounted to said planar mounting surface of said electric drive so that said second planar mounting surface and said planar mounting surface of said electric drive bear flat against each other, said first planar mounting surface and said second planar mounting surface being substantially parallel.

13. The article of furniture according to claim 12, wherein said transmission stage comprises a first transmission stage, said electric drive including a second transmission stage.

14. The article of furniture according to claim 12, wherein said transmission stage includes a transmission configured to locally displace transmission of force from said electric drive to said mechanical actuating unit.

15. The article of furniture according to claim 12, wherein said transmission stage includes a transmission configured to cause an increase or a reduction in a length of a travel path defined by a projection of said transmission stage.

16. The article of furniture according to claim 12, wherein said transmission stage includes a transmission configured to cause an increase or reduction in torque from said electric motor to said mechanical actuating unit.

17. The article of furniture according to claim 12, wherein said transmission stage has at least one drive mounting, said electric drive being mounted to said at least one drive mounting.

18. The article of furniture according to claim 12, wherein said transmission stage is fixed to said mechanical actuating unit.

19. The article of furniture according to claim 12, wherein said transmission stage is fixed to said electric drive.

20. The article of furniture according to claim 12, wherein said transmission stage is configured to be fixed to said mechanical actuating unit even if said mechanical actuating unit is already mounted to said furniture carcass.

21. The article of furniture according to claim 12, wherein said mechanical actuating unit, said transmission stage, and said electric drive are configured to be connected together so that flat side surfaces of said mechanical actuating unit, said transmission stage, and said electric drive lie against each other.

22. The article of furniture according to claim 12, wherein said mechanical actuating unit, said transmission stage, and said electric drive are configured to be releasably assembled together.

23. The article of furniture according to claim 12, wherein said transmission stage is fixed to the furniture carcass.

24. The device according to claim 1, wherein said electric drive has a pin projecting into a receiving section of said second planar mounting surface of said transmission stage so as to transmit force from said electric drive to said transmission stage.

25. The article of furniture according to claim 12, wherein said electric drive has a pin projecting into a receiving section of said second planar mounting surface of said transmission stage so as to transmit force from said electric drive to said transmission stage.

* * * * *